US009599947B2

(12) United States Patent
Kawajiri

(10) Patent No.: US 9,599,947 B2
(45) Date of Patent: Mar. 21, 2017

(54) IMAGE FORMING APPARATUS, CONTROL METHOD, AND PROGRAM

(71) Applicant: CANON KABUSHIKI KAISHA, Tokyo (JP)

(72) Inventor: Kensuke Kawajiri, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/743,288

(22) Filed: Jun. 18, 2015

(65) Prior Publication Data

US 2015/0370208 A1 Dec. 24, 2015

(30) Foreign Application Priority Data

Jun. 20, 2014 (JP) ..... 2014-127541

(51) Int. Cl.
*G03G 15/00* (2006.01)
*G03G 15/043* (2006.01)

(52) U.S. Cl.
CPC ..... *G03G 15/556* (2013.01); *G03G 15/043* (2013.01)

(58) Field of Classification Search
CPC ..... G03G 15/55; G03G 15/553; G03G 15/556
See application file for complete search history.

(56) References Cited

U.S. PATENT DOCUMENTS 5,724,627 A * 3/1998 Okuno ..... H04N 1/295 399/27
6,516,160 B1 * 2/2003 Rodriguez ..... H04N 1/00002 399/27
7,013,093 B2 * 3/2006 Nakazato ..... G03G 15/0849 399/27
7,558,494 B2 * 7/2009 Hatakeyama ..... G03G 15/553 399/120
7,675,649 B2 * 3/2010 Kawano ..... G03G 15/556 358/1.9
8,328,319 B2 * 12/2012 Tamaoki ..... B41J 3/01 235/494
2004/0218936 A1 * 11/2004 Dougherty ..... G03G 15/553 399/27
2005/0169648 A1 * 8/2005 Kin ..... G03G 15/5033 399/27
2006/0127108 A1 * 6/2006 Okuyama ..... G03G 15/0872 399/27
2008/0075482 A1 * 3/2008 Hirota ..... G03G 15/0877 399/30
2009/0232524 A1 * 9/2009 Takahashi ..... G03G 15/0849 399/27
2010/0061744 A1 * 3/2010 Kim ..... G03G 15/50 399/43

(Continued)

FOREIGN PATENT DOCUMENTS

JP 2006-343621 A 12/2006

*Primary Examiner* — David Gray
*Assistant Examiner* — Carla Therrien
(74) *Attorney, Agent, or Firm* — Canon USA Inc., IP Division

(57) ABSTRACT

When calculating a toner consumption amount that is based on a dot count value of raster data, the toner consumption amount can be estimated more accurately by taking into consideration density control as well as pulse width control, which are used as part of image formation processing.

10 Claims, 11 Drawing Sheets

(56) References Cited

U.S. PATENT DOCUMENTS

2012/0069361 A1* 3/2012 Jung ..... G03G 15/556
358/1.9
2012/0155893 A1* 6/2012 Hikosaka ..... G03G 15/0824
399/27
2013/0071130 A1* 3/2013 Hayashi ..... G03G 15/04054
399/27
2013/0242315 A1* 9/2013 Shimahashi ..... G03G 15/043
358/1.1
2014/0233969 A1* 8/2014 Nagai ..... G03G 15/556
399/27
2015/0302284 A1* 10/2015 Ido ..... G03G 15/556
358/1.9

* cited by examiner

FIG. 10

| DENSITY VALUE | CONSUMPTION ESTIMATION DENSITY CORRECTION VALUE |
|---|---|
| 1 | 0.8 |
| 2 | 0.9 |
| 3 | 1 |
| 4 | 1.1 |
| 5 | 1.2 |

FIG. 11A

| PRINTING MODE | PULSE WIDTH TABLE |
|---|---|
| NORMAL PRINTING | TABLE 1 |
| BARCODE PRINTING | TABLE 2 |
| HIGH-QUALITY PRINTING | TABLE 3 |

FIG. 11B

| GRADATION | PULSE WIDTH | CONSUMPTION ESTIMATION PULSE WIDTH CORRECTION VALUE | |
|---|---|---|---|
| 0 | 0 | P0 | 0 |
| 1 | 8 | P1 | 1 |

FIG. 11C

| GRADATION | PULSE WIDTH | CONSUMPTION ESTIMATION PULSE WIDTH CORRECTION VALUE | |
|---|---|---|---|
| 0 | 0 | P0 | 0 |
| 1 | 4 | P1 | 0.5 |

FIG. 11D

| GRADATION | PULSE WIDTH | CONSUMPTION ESTIMATION PULSE WIDTH CORRECTION VALUE | |
|---|---|---|---|
| 0 | 0 | P0 | 0 |
| 1 | 8 | P1 | 1 |
| 2 | 10 | P2 | 1.25 |
| 3 | 15 | P3 | 1.87 |

IMAGE FORMING APPARATUS, CONTROL METHOD, AND PROGRAM

BACKGROUND

Field

Aspects of the present invention generally relate to an image forming apparatus, a control method, and a program.

Description of the Related Art

An image forming apparatus forms an image on a sheet by using a printing material such as toner. Generally, the printing material is contained in a container unit such as a cartridge.

Japanese Patent Application Laid-Open No. 2006-343621 discusses a technique for estimating an amount of toner remaining within the cartridge based on a dot count value of raster data. Specifically, a toner consumption amount is calculated based on the dot count value of the raster data, and that toner consumption amount is subtracted from a current toner remaining amount to calculate a new toner remaining amount. Herein, the toner consumption amount is generally calculated by multiplying the dot count value of the raster data by a toner consumption coefficient previously determined at each apparatus.

However, the toner consumption amount is not always simply proportional to the dot count value of the raster data.

For example, if there is any variation in density control that changes a development bias voltage according to a density setting made by the user or pulse width control that changes an exposure amount of one dot according to a printing mode setting made by the user, an error in the estimated toner consumption amount may become greater.

SUMMARY

Aspects of the present invention are generally directed to a technique for more precisely estimating a toner consumption amount based on a dot count value of raster data.

According to an exemplary embodiment of the present invention, an image forming apparatus that executes image forming processing using a printing material includes a determination unit configured to determine an image forming condition relating to image density according to a user setting, an acquisition unit configured to acquire a dot count value of raster data, and a calculation unit configured to calculate, based on the dot count value acquired by the acquisition unit and the determined image forming condition, a consumption amount of the printing material consumed in the image forming processing.

Further features of the present disclosure will become apparent from the following description of exemplary embodiments with reference to the attached drawings.

BRIEF DESCRIPTION OF THE DRAWINGS

FIG. 10 is a correspondence table of density values and consumption estimation density correction values.

FIG. 11A is a correspondence table of printing modes and pulse width tables. FIGS. 11B, 11C, and 11D are correspondence tables of gradations and consumption estimation pulse width correction values in a normal printing mode, a barcode printing mode, and a high-quality printing mode, respectively.

DESCRIPTION OF THE EMBODIMENTS

Figure 1:
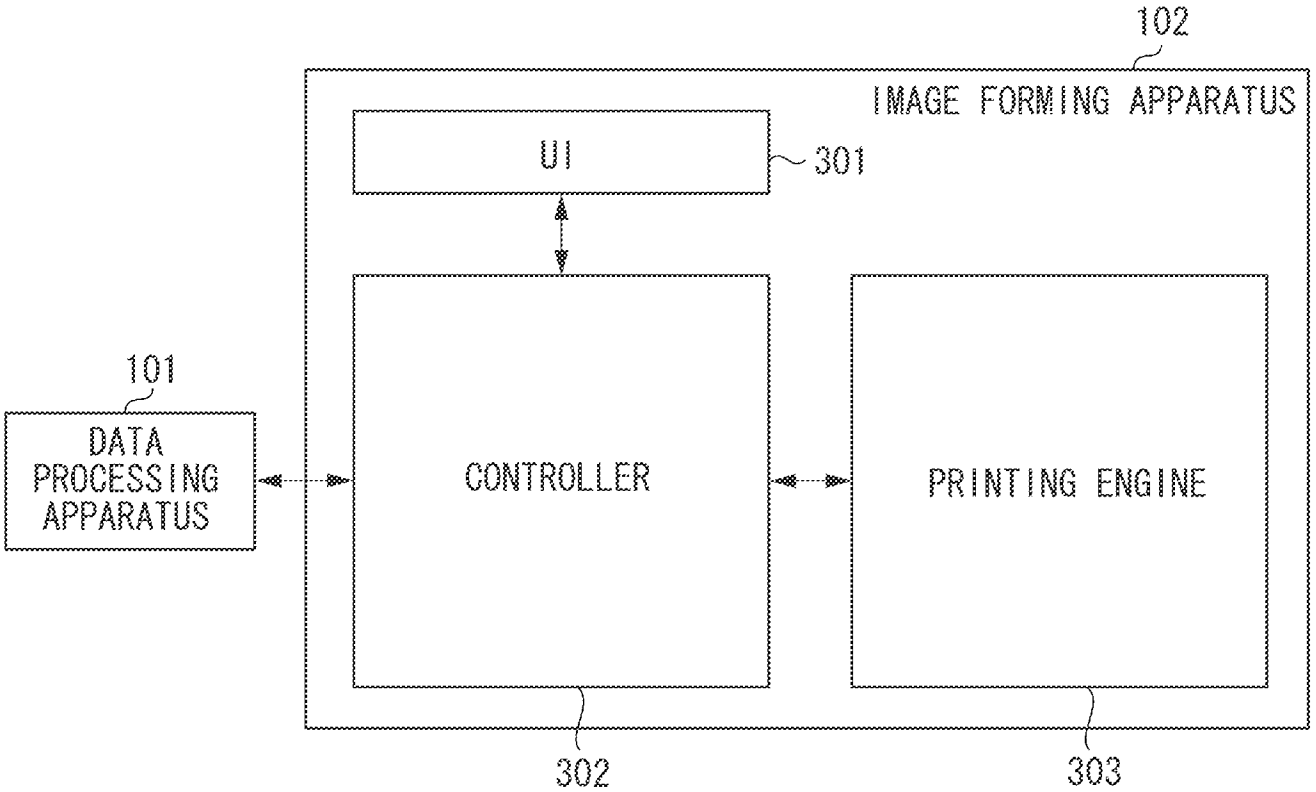
FIG. 1 is a block diagram illustrating a configuration of an image forming apparatus.

FIG. 1 is a block diagram illustrating a configuration of an image forming apparatus.

A data processing apparatus 101 such as a personal computer (PC) generates image data and transmits the image data to an image forming apparatus 102.

The image forming apparatus 102 such as a laser printer receives the image data from the data processing apparatus 101 and executes image forming processing on a sheet based on the image data. In addition, the image forming apparatus 102 may be a multifunction peripheral having a scanner function and a facsimile function.

A user interface (UI) 301 includes a display unit for notifying a user of various kinds of information and an operation unit for receiving various operations from the user. The display unit displays a current value of a toner remaining amount (described below). The current value of the toner remaining amount may be transmitted to an external apparatus such as the data processing apparatus 101 via an external interface (I/F), so as to be displayed on a display unit included in the external apparatus such as the data processing apparatus 101. Further, the user sets one of a plurality of modes of a printing engine 303 as an image forming mode (i.e., density setting) through the operation unit. According to the image forming mode set thereto, the below-described printing engine 303 determines an image forming condition relating to the image density, under which the printing engine 303 forms an image on a sheet by using a printing material. For example, a first image forming mode (i.e., first density setting) or a second image forming mode (i.e., second density setting) may be set as the image forming mode. If the bitmap data input to the printing engine 303 from the controller 302 is the same for the first and second image forming modes, an amount of the printing material used for the image forming processing will be less in the first image forming mode than in the second image forming mode. In other words, even if one-dot worth of data input to the printing engine 303 is the same for the first and second image forming modes, an amount of the printing material used for forming that one dot on a sheet will be less in the first image forming mode than in the second image forming mode. A printing mode set to a printing job is one example of the image forming mode. For example, a barcode printing mode (corresponding to the first image forming mode) or a normal printing mode (corresponding to the second image forming mode) may be set as the printing mode. Further, a setting value of a development bias voltage (referred to as "density setting value" or "density value") for the printing engine 303 in an electro-photographic system is another example of the image forming mode. For example, the development bias voltage may be set as a setting value (corresponding to the first image forming mode) higher than the normal setting value (corresponding to the second image forming mode).

The controller 302 generates bitmap data based on page description language (PDL) data and transmits the bitmap data to the printing engine 303. The controller 302 will be described below in detail with reference to FIG. 2.

Based on the bitmap data received from the controller 302, the printing engine 303 forms an image on a sheet by using toner in an electro-photographic method. In addition, for example, an image forming method other than the electro-photographic method such as an ink-jet method may be employed therefor. In such a case, while toner is used as a printing material in the electro-photographic method, ink is used as a printing material in the ink-jet method. The printing engine 303 will be described below in detail with reference to FIG. 3.

Further, the controller 302 and the printing engine 303 may be integrally configured as a single unit although they are described as separate units in this example.

Figure 2:
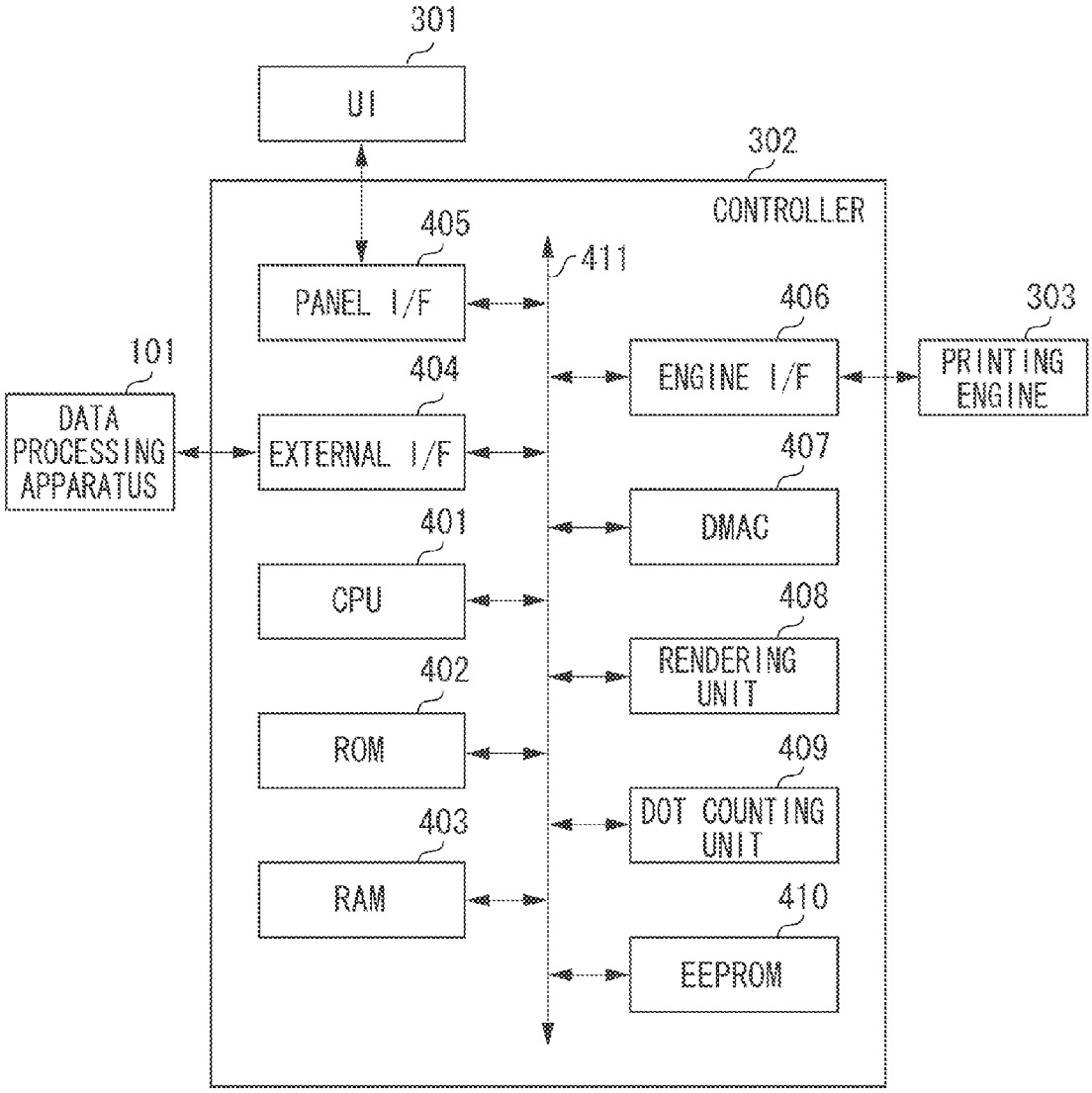
FIG. 2 is a block diagram illustrating a configuration of a controller.

FIG. 2 is a block diagram illustrating a configuration of the controller 302.

A central processing unit (CPU) 401 loads a program stored in a read only memory (ROM) 402 on a random access memory (RAM) 403, and controls the image forming apparatus 102 by executing the program. Further, as described below, the CPU 401 calculates a toner remaining amount based on an estimation value of the toner consumption amount converted from the dot count value counted by a dot counting unit 409 or a sensor value of the toner remaining amount notified by the printing engine 303. Then, the CPU 401 displays the calculated toner remaining amount on the UI 301 via a panel I/F 405, or notifies the data processing apparatus 101 of the calculated toner remaining amount via an external I/F 404.

The ROM 402 stores a program to be executed by the CPU 401.

The RAM 403 stores the program loaded from the ROM 402. Further, the RAM 403 stores PDL data, intermediate data generated by interpreting the PDL data, bitmap data generated by rendering the intermediate data, and various temporary processing statuses or log information necessary for other processing.

The external I/F 404 connects the data processing apparatus 101 and the controller 302 to relay data as data communication such as transmission and reception of data executed between the data processing apparatus 101 and the controller 302.

The panel I/F 405 connects the UI 301 and the controller 302 to relay data as data communication such as transmission and reception of data executed between the UI 301 and the controller 302.

An engine I/F 406 connects the printing engine 303 and the controller 302 to relay data as data communication such as transmission and reception of data executed between the printing engine 303 and the controller 302.

A direct memory access controller (DMAC) 407 receives an instruction from the CPU 401 to execute data access such as writing or reading data into/from the RAM 403.

A rendering unit 408 rasterizes intermediate data into bitmap data.

From among the dots included in the rasterized bitmap data, the dot counting unit 409 counts the number of dots for which toner is consumed at the time of image forming processing. Specifically, the number of dots having the color other than white is counted. For example, in a black-and-white printing mode, the number of dots corresponding to black (K) is counted. Further, in a color printing mode, the number of dots corresponding to any of yellow (Y), magenta (M), cyan (C), and black (K) is counted. In addition, the number of dots may be counted by the CPU 401 or the rendering unit 408.

An electrically erasable programmable read-only memory (EEPROM) 410 stores setting information of the image forming apparatus 102.

A bus 411 connects respective constituent elements included in the controller 302 with each other.

Figure 3:
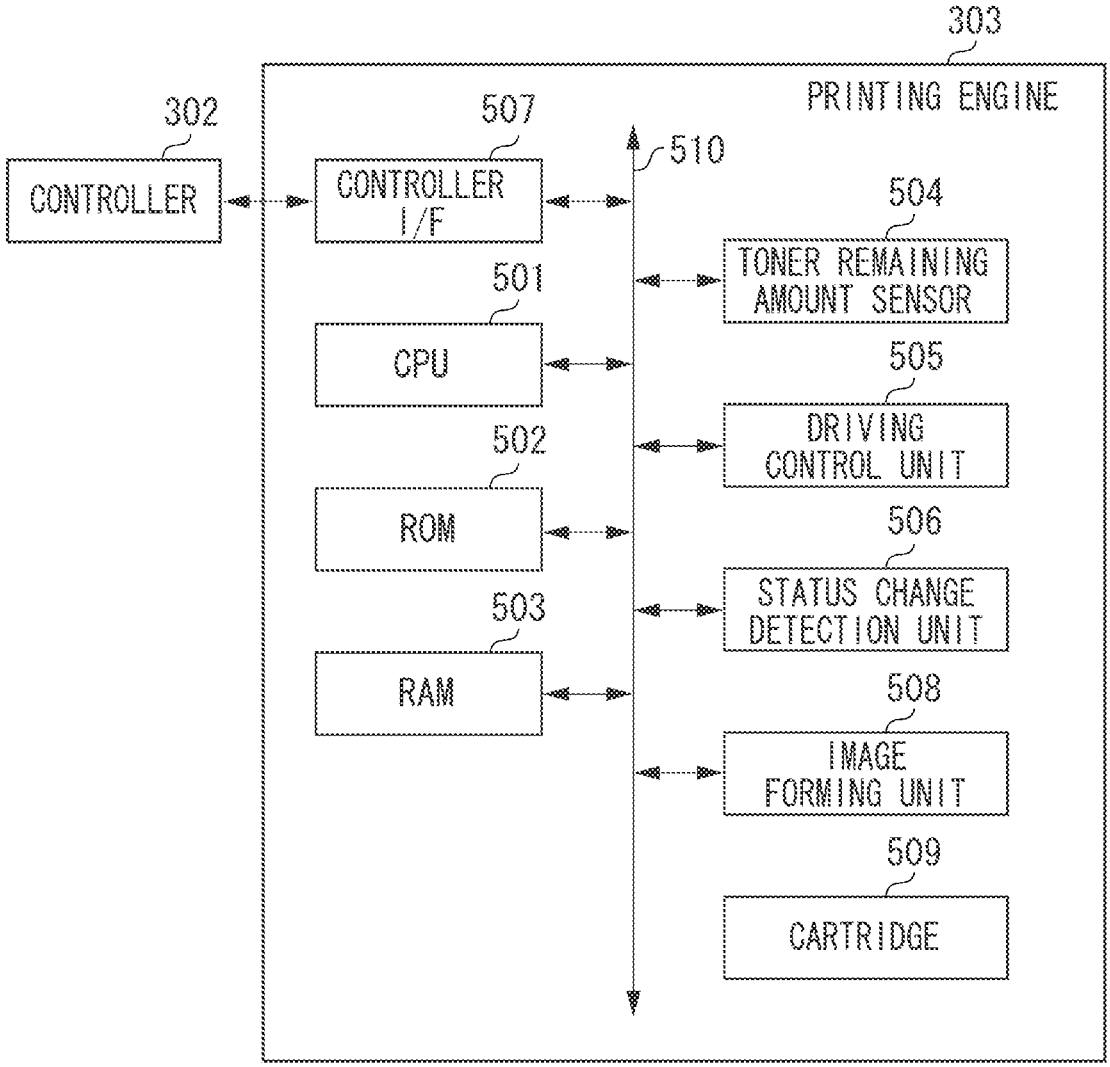
FIG. 3 is a block diagram illustrating a configuration of a printing engine.

FIG. 3 is a block diagram illustrating a configuration of the printing engine 303.

A CPU 501 loads a program stored in a ROM 502 on a RAM 503, and controls the printing engine 303 by executing the program.

The ROM 502 stores the program to be executed by the CPU 501.

The RAM 503 stores the program loaded from the ROM 502.

A toner remaining amount sensor 504 measures a remaining amount of toner contained within a cartridge 509. For example, a magnetic permeability detection method, a magnetic detection method, a piezoelectric vibration detection method, or a transmitted light detection method may be employed to detect the toner remaining amount of the toner remaining amount sensor 504. For example, when the toner remaining amount has reached a predetermined value such as 20% or 0%, the toner remaining amount sensor 504 determines that value as a sensor value. In other words, when the toner remaining amount shows 100% to 21%, 20% to 1%, or 0%, the toner remaining amount sensor 504 determines the sensor value as 100%, 20%, or 0%, respectively. In addition, the toner remaining amount sensor 504 may be included in the cartridge 509.

A driving control unit 505 drives various motors necessary for the image forming unit 508 to execute image forming processing.

A status change detection unit 506 detects a change in status such as a jamming state or an opening state of a cover arising in the image forming apparatus 102. Further, the status change detection unit 506 detects a replacement status of the cartridge 509. In addition, the change in status may be detected by the CPU 501.

A controller I/F 507 connects the controller 302 and the printing engine 303 to relay data as data communication such as transmission and reception of data executed between the controller 302 and the printing engine 303.

Based on the bitmap data received from the controller 302, the image forming unit 508 executes image forming processing on a sheet by using toner in the electro-photographic method.

The cartridge 509 is a process cartridge attachable to the image forming apparatus 102, serving as a container unit for containing toner. The cartridge 509 stores toner used in the image forming processing executed by the image forming unit 508. Further, the cartridge 509 includes a non-volatile storage medium, and cartridge information is stored therein. The cartridge information may be information indicating whether the cartridge 509 is new, color information indicating toner color, or toner remaining amount information indicating a current remaining amount of toner within the cartridge 509. Although the cartridge 509 is connected to a bus 510, the cartridge 509 may be connected to the CPU 501 via a dedicated line.

The bus 510 connects respective constituent elements included in the printing engine 303 with each other.

Figure 4:
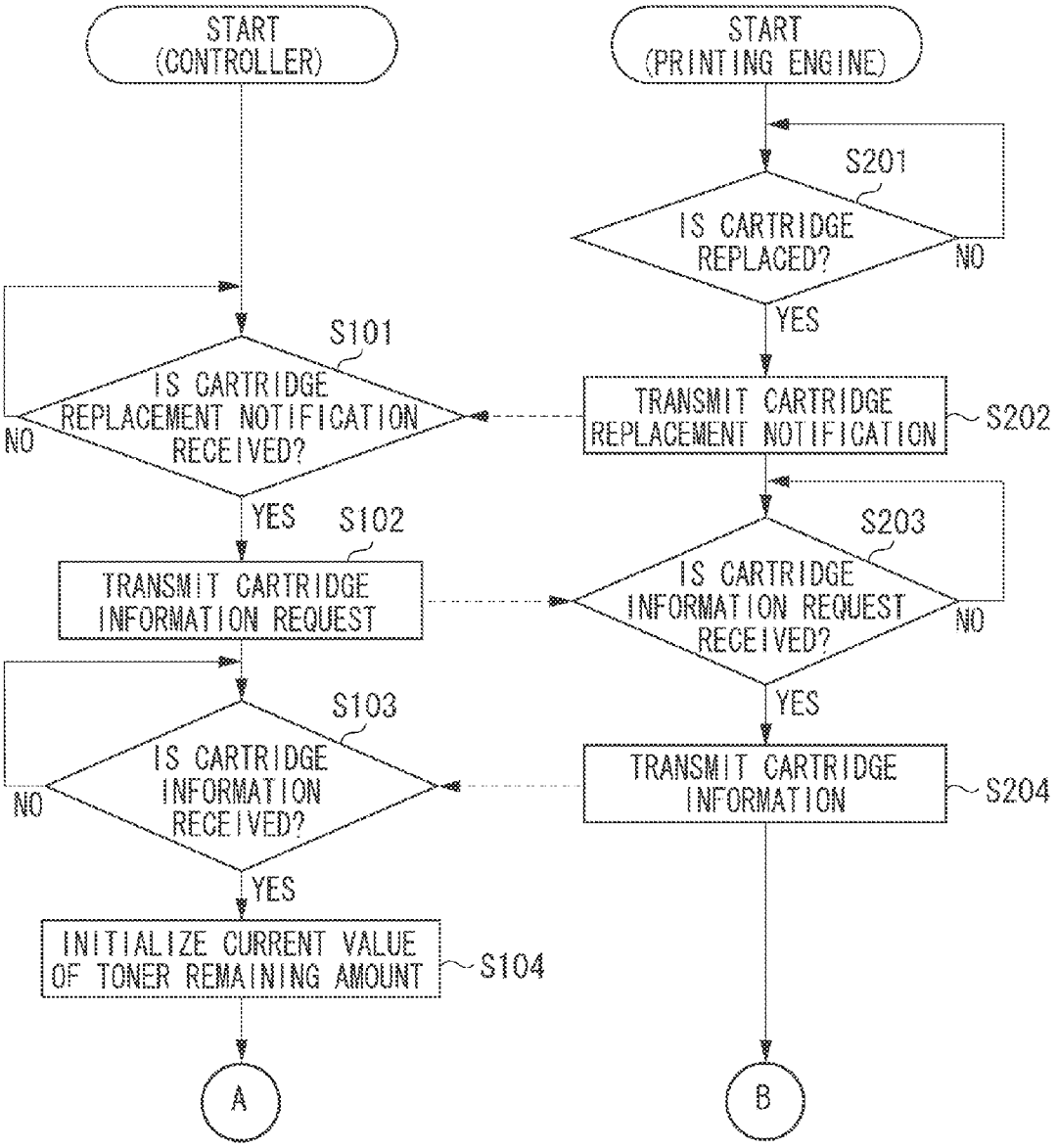
FIG. 4 is a flowchart illustrating a first half of control processing for detecting a toner remaining amount.
Figure 5:
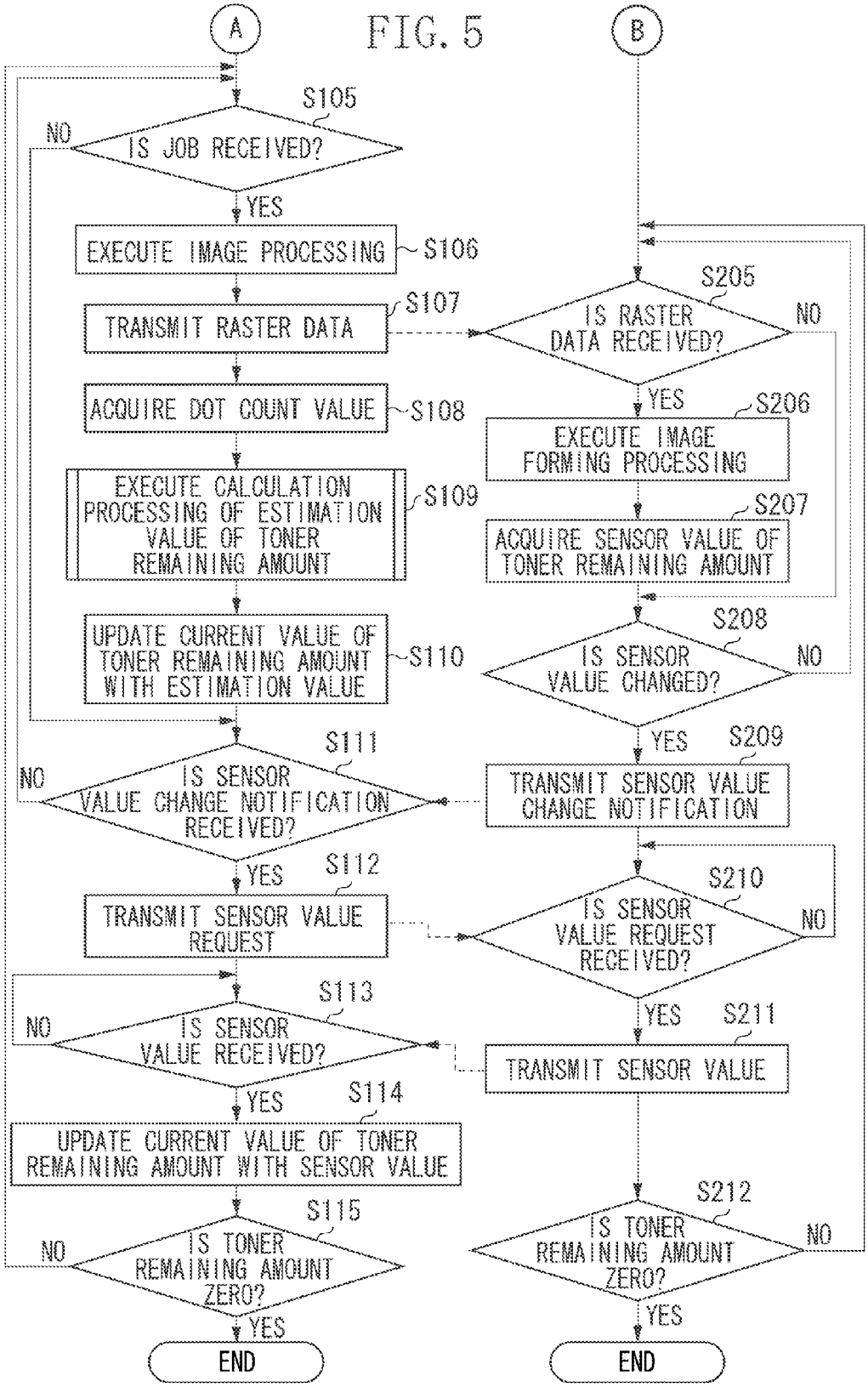
FIG. 5 is a flowchart illustrating a latter half of the control processing for detecting a toner remaining amount.

FIGS. 4 and 5 are flowcharts illustrating control processing for detecting the toner remaining amount.

The control processing illustrated in the flowchart on the left side is performed by the controller 302 when the CPU 401 loads a control program stored in the ROM 402 onto the RAM 403 to execute the control program. Further, the control processing illustrated in the flowchart on the right side is performed by the printing engine 303 when the CPU 501 loads a control program stored in the ROM 502 onto the RAM 503 to execute the control program.

First, in step S201, the CPU 501 determines whether the cartridge 509 is replaced. The CPU 501 makes the above determination when it is detected that the cartridge 509 is newly attached to the image forming apparatus 102. Attachment of the cartridge 509 is recognized when the status change detection unit 506 detects the attachment of the cartridge 509 to send a notification to the CPU 501. The attachment of the cartridge 509 may be detected by opening/closing of a cover to replace the cartridge 509, or may be detected by a button or a switch for physically changing the on/off status according to the attachment/detachment of the components. If the CPU 501 determines that the cartridge 509 is replaced (YES in step S201), the processing proceeds to step S202. If the CPU 501 determines that the cartridge 509 is not replaced (NO in step S201), the CPU 501 stands ready for the processing.

Next, in step S202, the CPU 501 transmits a cartridge replacement notification indicating that the cartridge 509 has been replaced to the controller 302 via the controller I/F 507.

Then, in step S101, the CPU 401 determines whether the cartridge replacement notification is received from the printing engine 303 via the engine I/F 406. If the CPU 401 determines that the cartridge replacement notification is received (YES in step S101), the processing proceeds to step S102. If the CPU 401 determines that the cartridge replacement notification is not received (NO in step S101), the CPU 401 stands ready for the processing.

Next, in step S102, the CPU 401 transmits a request for the cartridge information of the cartridge 509 to the printing engine 303 via the engine I/F 406.

Then, in step S203, the CPU 501 determines whether the cartridge information request is received from the controller 302 via the controller I/F 507. If the CPU 501 determines that the cartridge information request is received (YES in step S203), the processing proceeds to step S204. If the CPU 501 determines that the cartridge information request is not received (NO in step S203), the CPU 501 stands ready for the processing.

Next, in step S204, the CPU 501 transmits the cartridge information of the cartridge 509 to the controller 302 via the controller I/F 507.

Then, in step S103, the CPU 401 determines whether the cartridge information is received from the printing engine 303 via the engine I/F 406. If the CPU 401 determines that the cartridge information is received (YES in step S103), the processing proceeds to step S104. If the CPU 401 determines that the cartridge information is not received (NO in step S103), the CPU 401 stands ready for the processing.

Next, in step S104, based on the cartridge information, the CPU 401 initializes a current value of the toner remaining amount. The current value of the toner remaining amount is a value the controller 302 recognizes as the remaining amount of toner within the cartridge 509, which is displayed to the user via the UI 301.

Specifically, if the CPU 401 refers to the cartridge information and confirms that the cartridge 509 is new, the CPU 401 sets the current value of the toner remaining amount to "100%" to initialize the current value of the toner remaining amount. Further, if the CPU 401 cannot confirm whether the cartridge 509 is new, the CPU 401 sets the current value of the toner remaining amount to the value corresponding to the toner remaining amount information included in the above-described cartridge information. The current value of the toner remaining amount is stored in the RAM 403.

Next, in step S105, the CPU 401 determines whether a job on which the image forming processing is executed is received from the data processing apparatus 101 via the external I/F 404. Herein, the job may be a PDL printing job, a copying job, or a fax reception printing job. If the CPU 401 determines that the job is received (YES in step S105), the processing proceeds to step S106. If the CPU 401 determines that the job is not received (NO in step S105), the processing proceeds to step S111.

Next, in step S106, based on the job, the CPU 401 executes image processing necessary for forming an image. By controlling the rendering unit 408, the CPU 401 executes the image processing such as rasterizing printing data and generating raster data.

Next, in step S107, the CPU 401 transmits the raster data generated by the image processing to the printing engine 303 via the engine I/F 406.

Next, in step S108, the CPU 401 acquires a dot count value measured at the time of generation processing of the raster data from the dot counting unit 409. In addition, the dot count value may be acquired in a page unit or in a job unit.

Then, in step S109, based on the dot count value acquired in step S108, the CPU 401 executes calculation processing of an estimation value of the toner remaining amount. The calculation processing of the estimation value of the toner remaining amount will be described below in detail with reference to FIG. 7.

Next, in step S110, the CPU 401 updates the current value of the toner remaining amount with the estimation value calculated in step S109.

On the other hand, in step S205, the CPU 501 determines whether the raster data is received from the controller 302 via the controller I/F 507. If the CPU 501 determines that the raster data is received (YES in step S205), the processing proceeds to step S206. If the CPU 501 determines that the raster data is not received (NO in step S205), the processing proceeds to step S208.

In step S206, the CPU 501 controls the image forming unit 508 to execute image forming processing based on the raster data.

Then, in step S207, the CPU 501 acquires a sensor value of the toner remaining amount from the toner remaining amount sensor 504. The sensor value may be acquired when the image forming processing is completed either in a page unit or in a job unit. Further, the sensor value may be acquired each time a predetermined time has elapsed.

In step S208, the CPU 501 determines whether there is any change between the sensor value acquired this time and the sensor value acquired at a previous time. If the CPU 501 determines that the sensor value is changed (YES in step S208), the processing proceeds to step S209. If the CPU 501 determines that the sensor value is not changed (NO in step S208), the processing returns to step S205.

In step S209, the CPU 501 transmits a sensor value change notification indicating that the sensor value is changed to the controller 302 via the controller I/F 507.

Next, in step S111, the CPU 401 determines whether the sensor value change notification is received from the printing engine 303 via the engine I/F 406. If the CPU 401 determines that the sensor value change notification is received (YES in step S111), the processing proceeds to step S112. If the CPU 401 determines that the sensor value change notification is not received (NO in step S111), the processing returns to step S105.

In step S112, the CPU 401 transmits a sensor value request to the printing engine 303 via the engine I/F 406.

Next, in step S210, the CPU 501 determines whether the sensor value request is received from the controller 302 via the controller I/F 507. If the CPU 501 determines that the sensor value request is received (YES in step S210), the processing proceeds to step S211. If the CPU 501 determines that the sensor value request is not received (NO in step S210), the CPU 501 stands ready for the processing.

In step S211, the CPU 501 transmits the sensor value to the controller 302 via the controller I/F 507.

Then, in step S113, the CPU 401 determines whether the sensor value is received from the printing engine 303 via the engine I/F 406. If the CPU 401 determines that the sensor value is received (YES in step S113), the processing proceeds to step S114. If the CPU 401 determines that the sensor value is not received (NO in step S113), the CPU 401 stands ready for the processing.

Next, in step S114, the CPU 401 updates the current value of the toner remaining amount with the sensor value received in step S113. The sensor value acquired this time is stored in the RAM 403. If the sensor value acquired at the previous time has been stored therein, the CPU 401 updates the previous sensor value with the sensor value acquired this time.

Next, in step S115, the CPU 401 refers to the current value of the toner remaining amount and determines whether the toner remaining amount is zero. If the CPU 401 determines that the toner remaining amount is zero (YES in step S115), the CPU 401 ends the processing. If the CPU 401 determines that the toner remaining amount is not zero (NO in step S115), the processing returns to step S105.

On the other hand, in step S212, the CPU 501 refers to the sensor value of the toner remaining amount and determines whether the toner remaining amount is zero. If the CPU 501 determines that the toner remaining amount is zero (YES in step S212), the CPU 501 ends the processing. If the CPU 501 determines that the toner remaining amount is not zero (NO in step S212), the processing returns to step S205.

Figure 6:
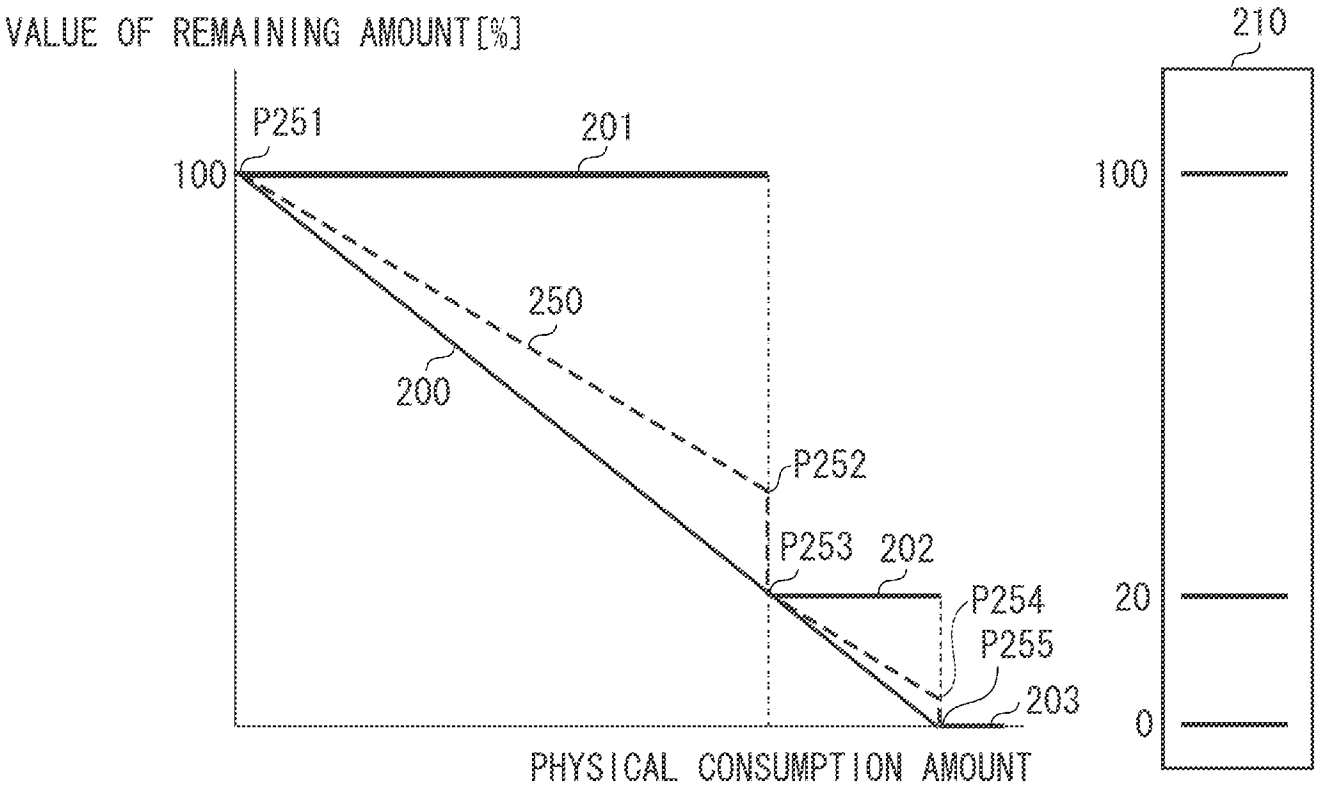
FIG. 6 is a graph illustrating transition of a current value of the toner remaining amount.

FIG. 6 is a graph illustrating transition of the current value of the toner remaining amount.

A solid line 200 indicates transition of the actual remaining amount of toner. Herein, the actual remaining amount of toner represents an exact value of the remaining amount of toner actually existing in the cartridge 509. Therefore, for example, unless the sensor can measure the remaining amount of toner within the entire area of the cartridge 509 with extremely high precision, it is very difficult to directly acquire the actual remaining amount thereof.

Solid lines 201, 202 and 203 indicate transition of the sensor value of the toner remaining amount.

A scale 210 indicates values that the sensor values of the toner remaining amount take. In the present exemplary embodiment, values of 100%, 20%, and 0% are taken as the sensor values, however, the values are not limited to the above.

A broken line 250 indicates transition of the current value of the toner remaining amount.

A point P251 corresponds to a point of time when the CPU 401 initializes the current value of the toner remaining amount in step S104 after the cartridge is replaced.

A section between the points P251 and P252 corresponds to a time during which the CPU 401 is calculating the estimation value of the toner remaining amount and updating the current value of the toner remaining amount in the loop processing of steps S105 to S111 until the sensor value 20% as the toner remaining amount is received.

A section between the points P252 and P253 corresponds to a time at which the CPU 401 updates the current value of the toner remaining amount with the sensor value 20% in step S114 when the sensor value 20% as the toner remaining amount is received. At this time, the CPU 401 notifies the user of low toner (i.e., the toner remaining amount has become low).

A section between the points P253 and P254 corresponds to a time during which the CPU 401 is calculating the estimation value of the toner remaining amount and updating the current value of the toner remaining amount in the loop processing of steps S105 to S111 until the sensor value 0% as the toner remaining amount is received.

A section between the points P254 and P255 corresponds to a time at which the CPU 401 updates the current value of the toner remaining amount with the sensor value 0% in step S114 when the sensor value 0% as the toner remaining amount is received. At this time, the CPU 401 notifies the user of toner out (i.e., no more toner left).

Figure 7:
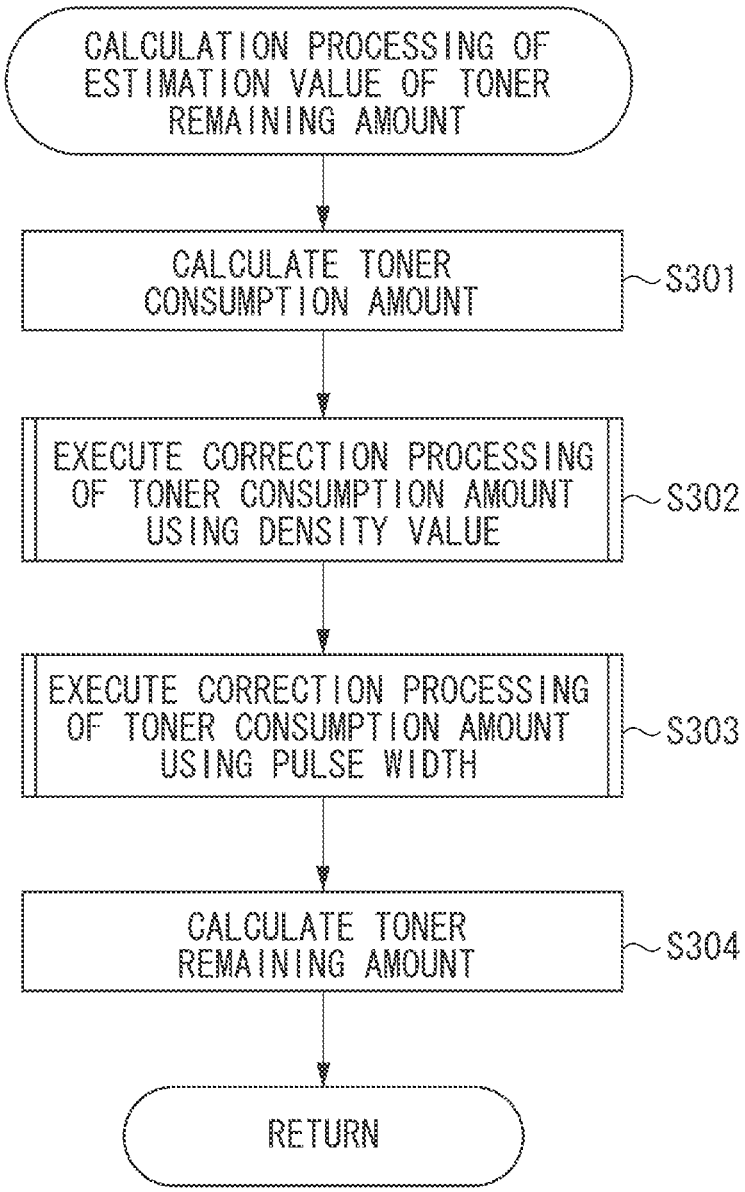
FIG. 7 is a flowchart illustrating details of calculation processing of an estimation value of the toner remaining amount.

FIG. 7 is a flowchart illustrating details of the calculation processing of the estimation value of the toner remaining amount.

First, in step S301, the CPU 401 calculates the toner consumption amount based on the following formula:

$S1=D\times G$, where S1 is the toner consumption amount (g), D is the number of dots (dots), and G is the toner consumption amount per dot (g/dot).

The toner consumption amount per dot may be previously stored in the ROM 402, or may be included in the cartridge information received in step S103. A symbol "x" represents multiplication.

Next, in step S302, with respect to the toner consumption amount calculated in step S301, the CPU 401 executes correction processing of the toner consumption amount using a density value. The correction processing of the toner consumption amount using the density value will be described below in detail with reference to FIG. 8.

Next, in step S303, with respect to the toner consumption amount after the correction processing is executed in step S302, the CPU 401 executes the correction processing of the toner consumption amount using a pulse width. The correction processing of the toner consumption amount using the pulse width will be described below in detail with reference to FIG. 9.

In the present exemplary embodiment, the correction processing using the pulse width has been executed in step S303 after executing the correction processing using the density value in step S302. However, the respective correction processing may be executed in a reverse order.

Next, in step S304, the CPU 401 uses the toner consumption amount after the correction processing is executed in step S303 to calculate the toner remaining amount based on the following formula:

$Z=C-S3$, where Z is a new toner remaining amount (g), C is the current toner remaining amount (g), and S3 is the toner consumption amount with the corrected pulse width (g).

In addition, the toner remaining amount may be calculated in percentage (%) based on the following formula:

Z'=Z/M, where Z' is the new toner remaining amount (%), Z is the new toner remaining amount (g), and M is a toner remaining amount of an unused cartridge (g). The toner remaining amount of the unused cartridge may be previously stored in the ROM 402, or may be included in the cartridge information received in step S103.

Figure 8:
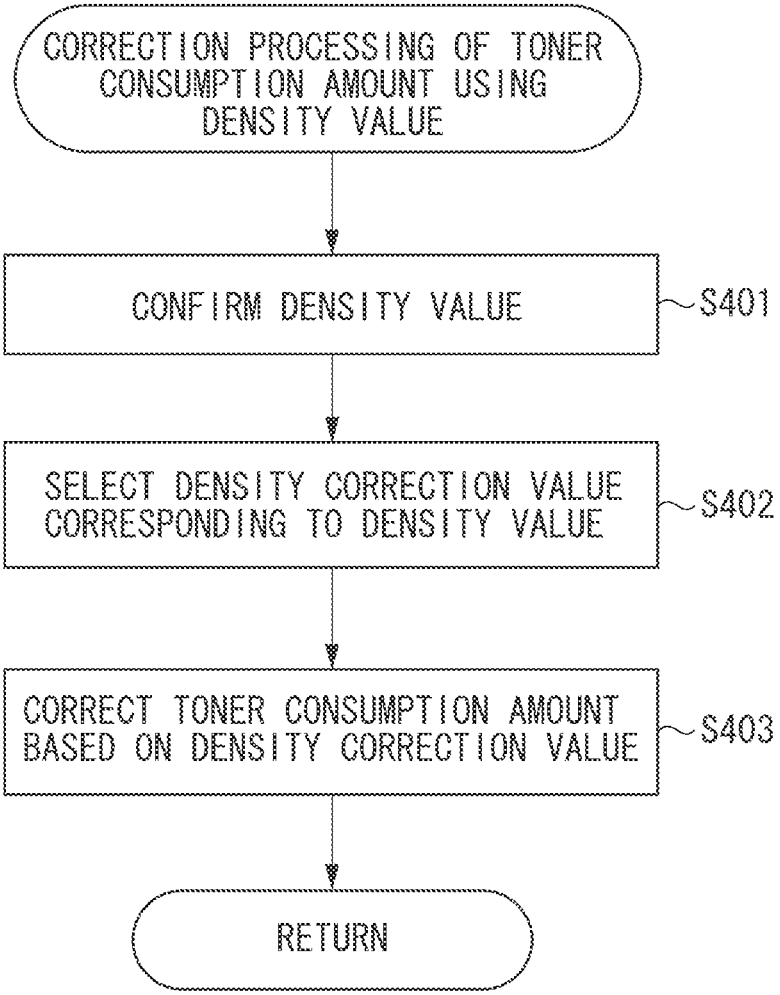
FIG. 8 is a flowchart illustrating details of correction processing of the toner remaining amount using a density value.

FIG. 8 is a flowchart illustrating details of the correction processing of the toner remaining amount using the density value.

First, in step S401, the CPU 401 confirms the density value (i.e., density setting value) currently set thereto. Herein, any of the density values from 1 to 5 is previously received from the user through the UI 301 and stored in the ROM 402. In other words, the user has set any one of a plurality of image forming modes (i.e., density values from 1 to 5) of the printing engine 303 as the image forming mode (i.e., density value) through the UI 301. By setting the density value, the image forming condition relating to the image density is determined. Because the amount of toner consumed to form one dot may vary in accordance with different image forming conditions, in order to acquire the accurate toner consumption amount, an appropriate consumption estimation density correction value has to be selected according to the density value set by the user as described below.

Next, in step S402, the CPU 401 refers to FIG. 10 to select and specify the consumption estimation density correction value corresponding to the density value confirmed in step S401 from among the plurality of density values. FIG. 10 is a correspondence table of a density value and a consumption estimation density correction value. This correspondence table is stored in the ROM 402.

Next, in step S403, the CPU 401 uses the consumption estimation density correction value selected in step S402 to correct the toner consumption amount calculated in step S301 based on the following formula:

S2=S1×N, where S2 is the toner consumption amount with the corrected density value (g), S1 is the toner consumption amount (g), and N is the consumption estimation density correction value.

In the present exemplary embodiment, the toner consumption amount S1 calculated in step S301 is multiplied by the consumption estimation density correction value N. However, the processing executed in steps S401 and S402 may be executed concurrently with the processing executed in step S301 to acquire the consumption estimation density correction value N. In this case, instead of executing the processing in step S403, in step S301, the acquired correction value N is multiplied by the coefficient G indicating the toner consumption amount per dot, and the coefficient G' serving as a multiplication result is further multiplied by the number of dots D. Through the above processing, the toner consumption amount S2 may be directly acquired in step S301.

Further, instead of acquiring a new coefficient G' by multiplying the coefficient G by the correction value N, different coefficient G' corresponding to each density value set by the user may be previously stored in the ROM 402. In this case, in step S301, the appropriate coefficient G' corresponding to the density value set thereto is selected and used in substitution for the coefficient G in the formula described in step S301. With the above processing, the toner consumption amount S2 may be directly acquired in step S301.

Figure 9:
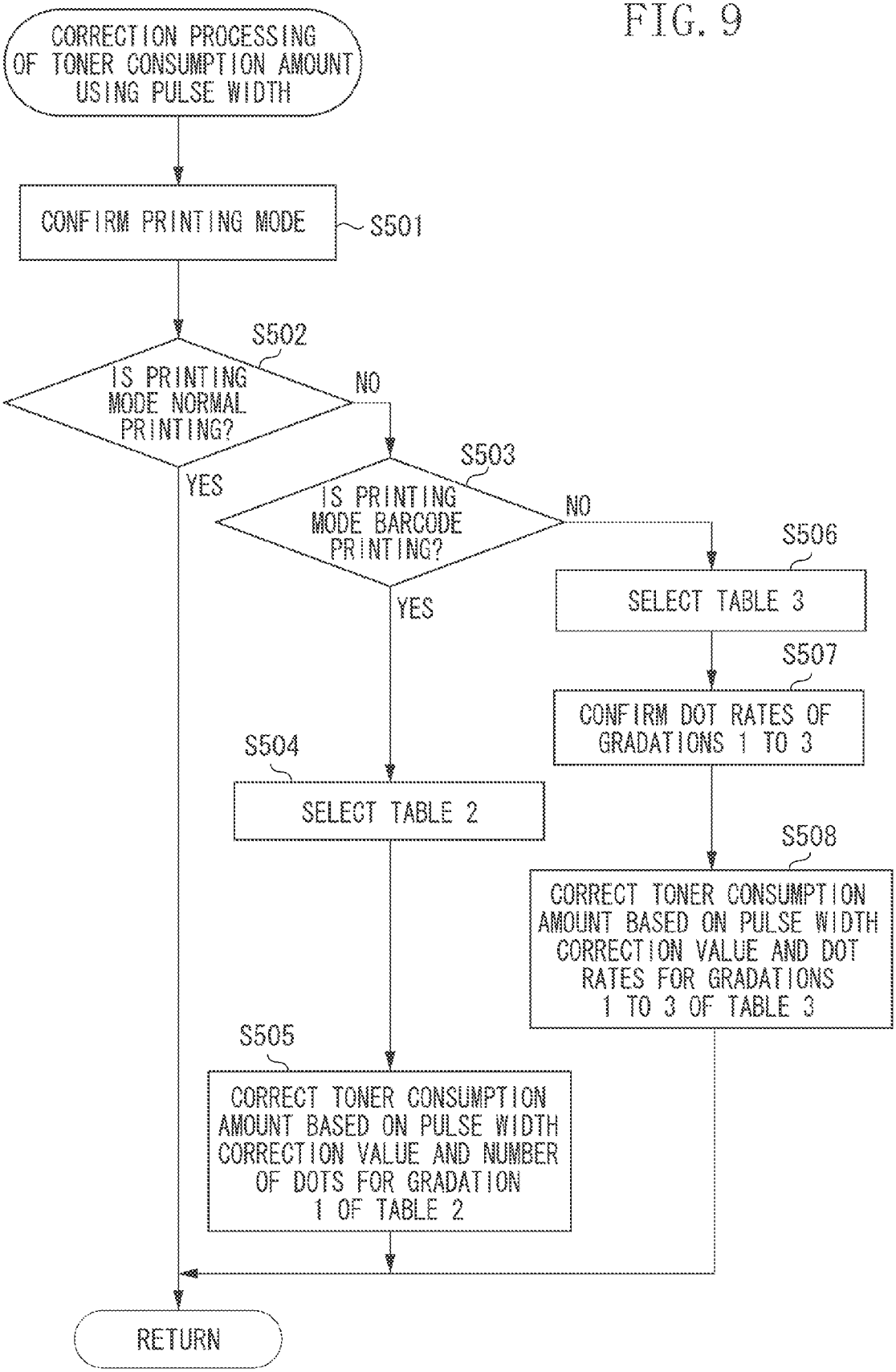
FIG. 9 is a flowchart illustrating details of correction processing of the toner remaining amount using a pulse width.

FIG. 9 is a flowchart illustrating details of the correction processing of the toner remaining amount using the pulse width.

First, in step S501, the CPU 401 confirms a printing mode set to a printing job. As a print setting of the print job, any of a normal printing mode, a barcode printing mode, and a high-quality printing mode is set as the printing mode.

Next, in step S502, the CPU 401 determines whether the printing mode confirmed in step S501 is the normal printing mode. If the CPU 401 determines that the printing mode is the normal printing mode (YES in step S502), the CPU 401 ends the processing. If the CPU 401 determines that the printing mode is not the normal printing mode (NO in step S502), the processing proceeds to step S503.

Next, in step S503, the CPU 401 determines whether the printing mode confirmed in step S501 is the barcode printing mode. If the CPU 401 determines that the printing mode is the barcode printing mode (YES in step S503), the processing proceeds to step S504. If the CPU 401 determines that the printing mode is not the barcode printing mode (NO in step S503), the processing proceeds to step S506.

Next, in step S504, the CPU 401 refers to FIG. 11A and selects Table 2 as the pulse width table corresponding to the barcode printing mode. FIG. 11A is a correspondence table of the printing mode and the pulse width table. This correspondence table is stored in the ROM 402.

Next, in step S505, the CPU 401 uses the consumption estimation density correction value of FIG. 11C, which corresponds to Table 2 selected in step S504, to correct the toner consumption amount calculated in step S403 based on the following formula. FIG. 11C is a correspondence table of a gradation and a consumption estimation pulse width correction value in the barcode printing mode. This correspondence table is stored in the ROM 402.

S3=S2×P1, where S3 is the toner consumption amount with the corrected pulse width (g), S2 is the toner consumption amount with the corrected density value (g), and P1 is the consumption estimation pulse width correction value for gradation 1.

Next, in step S507, the CPU 401 confirms the dot rates corresponding to the gradations 1 to 3 from among number of the dots counted by the dot counting unit 409.

Next, in step S508, the CPU 401 uses the consumption estimation density correction value of FIG. 11D, which corresponds to Table 3 selected in step S506, to correct the toner consumption amount calculated in step S403 based on the following formula. FIG. 11D is a correspondence table of a gradation and a consumption estimation pulse width correction value in the high-quality printing mode. This correspondence table is stored in the ROM 402.

S3=S2×((R1×P1)+(R2×P2)+(R3×P3))/100, where S3 is the toner consumption amount with the corrected pulse width (g), S3 is the toner consumption amount with the corrected density value (g), R1 is the dot rate for the gradation 1(%), P1 is the consumption estimation pulse width correction value for the gradation 1, R2 is the dot rate for the gradation 2(%), P2 is the consumption estimation pulse width correction value for the gradation 2, R3 is the dot rate for the gradation 3 (5), and P3 is the consumption estimation pulse width correction value for the gradation 3.

In the present exemplary embodiment, in a case where a result of determination processing executed in step S502 is "YES", the correction processing of the toner consumption amount using the pulse width is omitted. However, the CPU 401 may use the consumption estimation density correction value of FIG. 11B to correct the toner consumption amount calculated in step S403 based on the formula that is the same as that of step S505. Because the consumption estimation pulse width correction value for the gradation 1 is one, the result will be the same as in the case of omitting the correction processing of the toner consumption amount using the pulse width.

According to the above-described exemplary embodiments, in the technique for estimating the toner consumption amount based on the dot count value of raster data, the toner consumption amount can be estimated more accurately by taking density control and pulse width control into consideration.

Other Embodiments

Additional embodiment(s) can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2014-127541, filed Jun. 20, 2014, which is hereby incorporated by reference herein in its entirety.

What is claimed is:

1. A printing apparatus that prints an image using a printing material, the printing apparatus comprising:

a receiving unit configured to receive print data;

a selecting unit configured to select a printing mode from among a plurality of printing modes according to a user setting;

a rendering unit configured to generate raster data based on the print data;

a printing unit configured to print the image based on the raster data using the printing material according to the selected printing mode;

an acquiring unit configured to acquire a dot count value of the raster data; and a calculating unit configured to calculate, based on the acquired dot count value and the selected printing mode, an estimation value of consumption amount of the printing material consumed in the printing, wherein, in at least one of the plurality of printing modes, the raster data can include at least a first dot and a second dot of which pulse width is narrower than a pulse width of the first dot, the widest pulse width of a dot that the raster data can include differs based on the selected printing mode, and one or more predefined correction coefficients used for calculating the estimation value differs according to a width of a dot in the raster data.

2. The printing apparatus according to claim 1, wherein, the calculating unit calculates the estimation value of the consumption amount by multiplying the acquired dot count value by the predefined correction coefficient.

3. The printing apparatus according to claim 1, wherein the calculating unit calculates the estimation value of the consumption amount by multiplying the dot count value, a fixed coefficient, and the predefined correction coefficient together.

4. The printing apparatus according to claim 3, wherein the calculating unit calculates the estimation value of the consumption amount by multiplying a multiplication result of the acquired dot count value and the fixed coefficient by the predefined correction coefficient.

5. The printing apparatus according to claim 3, wherein the calculating unit calculates the estimation value of the consumption amount by multiplying the acquired dot count value by a multiplication result of the fixed coefficient and the predefined correction coefficient.

6. The printing apparatus according to claim 1, wherein, the calculating unit uses, in the calculation, any one of different predefined correction coefficients according to a setting value for setting a development bias voltage of the printing unit, the different predefined correction coefficients resulting in, in the calculation, different estimation values for the widest pulse width.

7. The printing apparatus according to claim 1, wherein the printing mode is designated according to the received print data.

8. The printing apparatus according to claim 7, wherein the plurality of printing modes includes a normal printing mode and a barcode printing mode.

9. The printing apparatus according to claim 1, further comprising:

a confirmation unit configured to confirm a first ratio of a number of the first dots to a number of the dots in the raster data and a second ratio of the second dots to a number of the dots in the raster data, in a case where the selecting printing mode is a high-quality printing mode; and a storing unit configured to store at least a first predefined correction coefficient corresponding to the pulse width of the first dot and a second predefined correction coefficient corresponding to the pulse width of the second dot, wherein the calculating unit calculates the estimation value of the consumption amount using a sum of a first multiple result and a second multiple result, and wherein the first multiple result is acquired by multiplying the first ratio and the first predefined correction coefficient and the second multiple result is acquired by multiplying the second ratio and the second predefined correction coefficient.

10. A method for calculating an estimated amount of a printing material consumed when printing is executed using the printing material, the method comprising:

receiving print data;

selecting a printing mode among a plurality of print modes according to a user setting;

generating raster data based on the print data;

printing the image based on the raster data using the printing material according to the selected printing mode;

acquiring a dot count value of the raster data; and calculating, based on the acquired dot count value and the selected printing mode, an estimation value of consumption amount of the printing material consumed in the printing, wherein, in at least one of the plurality of printing modes, the raster data can include at least a first dot and a second dot of which pulse width is narrower than a pulse width of the first dot, the widest pulse width of a dot that the raster data can include differs based on the selected printing mode, and one or more predefined correction coefficients used for calculating the estimation value differs according to a width of a dot in the raster data.

* * * * *